US006105531A

United States Patent [19]

Knight

[11] Patent Number: 6,105,531

[45] Date of Patent: Aug. 22, 2000

[54] KAYAK KNEE BRACE AND METHOD OF PLACEMENT

[76] Inventor: Robert A. Knight, 4301 Doo Dah Dr., Somerset, Calif. 95684

[21] Appl. No.: 09/078,399

[22] Filed: May 13, 1998

[51] Int. Cl.[7] ..... B63B 35/00

[52] U.S. Cl. ..... 114/347

[58] Field of Search ..... 114/343, 347, 114/363, 153; 440/104, 105, 106, 107, 108; 112/260

[56] References Cited

U.S. PATENT DOCUMENTS

| | | | |
|---|---|---|---|
| 3,769,645 | 11/1973 | Lettman . | |
| 4,106,143 | 8/1978 | Lucas . | |
| 4,407,216 | 10/1983 | Masters . | |
| 4,589,365 | 5/1986 | Masters . | |
| 5,257,590 | 11/1993 | Foote . | |
| 5,367,976 | 11/1994 | Van Schaik | 114/347 |
| 5,375,543 | 12/1994 | Birman | 112/260 |
| 5,417,179 | 5/1995 | Niemier . | |

FOREIGN PATENT DOCUMENTS

| | | |
|---|---|---|
| 2641-757 | 7/1990 | France . |
| 2673416-A1 | 9/1992 | France . |

*Primary Examiner*—Stephen Avila
*Attorney, Agent, or Firm*—Joseph E. Gerber

[57] ABSTRACT

A knee brace for a kayak includes a structural backbone constructed of a rigid plate bent at an angle, the inside surface of the plate's curved form is lined with a resilient foam pad. The crease where the plate is bent divides it roughly into first and second portions, the first portion having a series of apertures for mounting the brace to the underside of the rearward portion of the foredeck, the second portion of the plate depending generally perpendicularly when mounted and being adapted to receive force from the inner face of the knee and lower thigh portions of a kayaker' leg. The series of apertures in the first portion of the plate is linearly arranged, but offset from the crease by 20 degrees, or so. A channel is cut out in the foam beneath the series of apertures. The first portion of the plate also includes a mating fabric patch able to be engaged with a complementary mating fabric patch which may be affixed either to the underside of the rearward portion of the kayak's foredeck, or to the underside of the tail portion of a C-shaped brace plate, if the kayak is so equipped. A round-head screw passes downward from the upper side of the rearward portion of the kayak's foredeck, and down through one of the apertures in the first portion of the brace plate to where a T-nut is engaged with the screw and holds the knee brace in place.

43 Claims, 7 Drawing Sheets

KAYAK KNEE BRACE AND METHOD OF PLACEMENT

BACKGROUND OF THE INVENTION

1. Field of the Invention

The present invention relates generally to braces for secure engagement of body parts with surfaces such as the interiors of vehicles, and the like, particularly watercraft. And, the invention relates more specifically to padded braces used in plastic and fiberglass kayaks and like watercraft for secure engagement of the user with the watercraft, and for permitting the user to apply force against portions of the watercraft to control the watercraft's movement and performance.

In the sport of kayaking, and especially in the subcategory of that sport practiced in rushing rivers commonly referred to as "whitewater" kayaking, it is important that the user of the kayak have a snug, yet comfortable, fit in the watercraft's cockpit. A good fit at the buttocks, lower back hips, thighs, knees and feet is critical to proper control of the craft's roll, pitch and yaw. To achieve the best fit, it has been common practice to fashion a custom seating area out of blocks of dense, resilient, closed-cell foam, trimming and shaving down the surfaces to match the contours of the owner's physique until the seat grasps the user's buttocks and thighs snugly. The feet are normally placed against a pair of foot pads, pegs, or a bulkhead wall, adjustable fore and aft to a point which, optimally, permits the user's knees and the adjacent, distal portion of the user's thighs to be splayed outward and wedged against the side walls of the hull, under those portions of the foredeck that extend rearward to the right and left of the cockpit. Reference to the distal portion of the user's thigh is intended to direct attention to that portion of the thigh farthest from the pelvis.

The points where the knees and distal thigh portions wedge against the side walls and up under the left and right rearward foredeck portions need to be fashioned for secure, comfortable engagement of the knees and distal thighs with the craft. Indeed, those points of engagement are extremely important, because it is the user's application of force against those points with the knees and distal thighs which yields precise edge control, i.e. the ability to raise one side edge of the craft higher than the other in reference to the water line. Edge control is essential to efficient turning, lateral movement and cross-current travel, as well as in righting the craft with the "Eskimo roll" maneuver after a flip. Thus, simply providing padding for distal thigh-knee force in a horizontally outward direction against the hull's outer walls, i.e. perpendicularly away from the central, longitudinal axis of the kayak, as was done in the past, is not sufficient. Force also often needs to be applied in an upward direction, i.e. vertically under the left or right rearward foredeck portions. Thus, the undersides of the deck in these side areas have been found to need padding, as well.

Further, many maneuvers require means to use the distal thigh and knee in drawing the hull wall in an inward direction, i.e. horizontally toward the central, longitudinal axis of the kayak. Different sculpted, overhanging foam pad configurations, straps, and other devices have been experimented-with in attempting to give kayakers more ability to use the knees and distal thighs to draw the hull wall toward the center of the craft. But, modernly, it has become standard practice for whitewater kayak manufacturers to form the left and right rearward portions of the foredeck, flanking the forward end of the cockpit, to wrap over the distal thigh and knee. In such constructions, short, wing-like panels generally referred to as "knee braces" depend rigidly from the inner edges of the cockpit rim to retain and receive force from the inner anterior surfaces of the distal thigh-knee region of each of the user's legs. Alternatively, several current manufacturers mold such rigid, depending, wing-like, knee braces into various types of reinforcing "brace plates." Such brace plates are generally C-shaped in plan view, four to ten inches or so wide, and adapted to be fastened to the underside of a kayak's deck, surrounding the front of the cockpit and its forward left and right sides. Examples of such C-shaped brace plates are found in whitewater kayaks currently sold by Perception, Wave Sport, and Dagger. However, because these rigid structural knee brace components are designed in a "one size fits all" fashion, they pose continuing problems in custom fitting kayaks to the user.

Despite the rigid structural components of knee braces being part of most modern mass-manufactured kayaks, they pose continuing problems in custom-fitting a kayak to a particular user. Due to the great variation in leg lengths and thicknesses among kayakers, for the best fit and control it has been common practice to line the entire area within each knee brace with dense, resilient, closed-cell foam and then to sculpt the surfaces to receive the anterior face and the anterior portions of the inner and outer side faces of the knee and adjacent distal end of the thigh of the intended user. This is a time-consuming, expensive process. And, for some unusual-sized kayakers, no amount of custom foam work is adequate; the position of the fixed knee brace and/or the limited room provided therewithin make a comfortable fit impossible. Further, once a good fit is achieved with custom-sculpted foam, presumably for the kayak's owner, it becomes very difficult for a person with a different body shape or size to fit, use and properly control the craft in comfort.

Thus, these problems with knee brace fit contribute to several persistent barriers to flexibility and versatility of equipment use in the sport of whitewater kayaking. First, they make it more difficult for the prospective purchaser of a new kayak to field-test the craft under conditions which permit full use of all of its control surfaces. Second, the purchaser of a used kayak must endure the discomfort of a less-than-optimum fit and attendant lack of performance, or otherwise be saddled with the bother and expense of re-sculpting the knee brace portions of the craft. Third, knee brace fit problems caused by permanent pad installations prevent paddling companions from swapping kayaks and trying out different hull sizes and constructions, thus unnecessarily limiting the range of experience one might otherwise enjoy if knee and distal thigh fit were not so critical to kayak comfort and control.

Recently, two well-known whitewater kayak manufacturing companies have introduced adjustable knee brace systems. WildWasser Sport USA, Inc. of Boulder, Colo. offers adjustable knee braces in its Prijon line of boats, and Impex International of Bellport, N.Y. offers adjustable knee braces in its Pyranha line. However, both the Prijon and the Pyranha systems only permit the knee brace to be adjusted along a line parallel with the kayak's central, longitudinal axis. Further, the depending, wing-like, rigid, knee and distal thigh-engaging panels used in these unidimensionally-adjustable systems are fixed at angles divergent from the kayak's seat toward its bow, but these angles are set for the "average-sized" kayaker. Thus, although permitting some adjustment for comfort and control, and eliminating the need for some of the custom foam sculpting, analyses of the differences in geometry of human bodies of different sizes, supported by empirical studies, leads to the inevitable conclusion that the Prijon and Pyranha unidimensionally-adjustable knee brace systems do not address all of the needs for a good, adjustable distal thigh-knee fit. Indeed, it can be readily appreciated that the inside thigh surfaces of the fully-splayed legs of a short-statured kayaker reside at an angle much more divergent from the kayak's longitudinal axis than those of a tall, long-legged kayaker. Thus, the rearward edge of a fixed-angle, longitudinally-adjustable knee brace panel, when driven fully rearward in the cockpit, will tend to dig into the distal thigh of a short-legged kayaker; and, the forward edge thereof will tend to dig into the knee of a long-legged kayaker when driven fully forward.

Another aspect of human geometry not addressed by the Prijon and Pyranha knee braces is that, in the context of conventionally-shaped whitewater kayak, the longer a kayaker's legs, the closer together the knees must be. That is because a kayak, in plan view, is tapered from cockpit to bow. Thus, the farther forward a knee brace is moved along an adjustment track fixed parallel to a kayak's longitudinal axis, the less room is left laterally between the depending, rigid, knee brace panel and the hull side wall. The longest-legged kayakers, therefore, have each knee pinched into its respective brace. Of course, this is most uncomfortable for long-legged kayakers whose legs are very thick, as well.

Yet another need not addressed by the conventional construction of knee braces is in adjustment of the height of the brace over the knee of the kayaker. Knee brace height is normally adjusted by starting with a thick block of foam and shaving it down to achieve the correct height. Generally, more foam is needed for high-decked kayaks, and less foam is needed for those with low decks. But, once set, the fit cannot be temporarily adjusted to fit another kayaker.

In attempts to permit multiple, different-sized kayakers the use the same kayak without completely re-sculpting the cockpit, some kayak renters, trip outfitters and the like, line some of the inside surfaces of the kayak cockpit with patches of fastening fabric such as Velcro, and then employ a collection of Velcro-backed knee, hip and lower back pads of different shapes, sizes and thicknesses to approximate a custom fit. This approach has some advantages, but the considerable stresses on some of these pads during a vigorous whitewater workout tend to tear the mating Velcro patches apart, causing the pad to be separated from the cockpit shell and, ultimately, causing loss of control. Further, during a quick exit from a kayak in whitewater conditions, such pads are easily torn loose and lost. However, one of the most difficult aspects of using mating Velcro patches for pad placement is that they provide no mechanism for fine incremental adjustments. Once placed in position, if the fit is not optimum, slight adjustments are not possible. The pad and its Velcro patch must be completely disengaged from the Velcro patch in the cockpit before being moved and replaced. This is quite difficult and can become very time consuming, because it requires that the kayaker being fitted continually climb in and out of the cockpit for readjustment.

Adjustable knee-thigh braces employed in a related class of craft known as "sit-on-top" kayaks, i.e. those having a completely closed hull, are also known. One example is shown in French Patent No. 2,641,757 issued to Rerolle in 1990 wherein knee braces ("stop surfaces 5,6") project laterally from a hump-shaped forward, central hull astride which the kayaker sits. However, Rerolle's knee braces appear adjustable fore and aft, at best.

U.S. Pat. No. 4,589,365 issued to Masters in 1986 shows longitudinally-adjustable thigh braces ("wing members" 70 and 72) for a sit-on-top kayak. However, Masters does not suggest these braces should be adjustable in any other plane or direction.

French Patent No. 2,673,416 issued to Brissaud in 1992 shows another sit-on-top with thigh braces ("overhangs" 1 and 2). Brissaud's braces may be either fixed, as shown in an embodiment where they are integral with the rest of the closed-hulled craft, or adjustable, as shown in another embodiment where they comprise separate structures. However, adjustability appears to be limited to the longitudinal direction.

Thus, it appears that a need exists for a kayak knee brace which is adjustable both longitudinally and laterally. And, optimally, the brace's depending panel should lie flush against the inside and anterior surfaces of the user's knee and distal thigh, whether the user has short, wide-splayed legs, or long, less-divergent legs. It would also be advantageous if such a kayak knee brace were easy to position and reposition securely by a lower-skilled kayak cockpit outfitter, thereby reducing the cost of fitting new and used boats to new users, and making it easier for paddling companions to make temporary cockpit outfitting adjustments for the purpose of borrowing one anothers' boats.

SUMMARY OF THE INVENTION

The adjustable kayak knee brace of the present invention is adapted to overcome the above-noted shortcomings and to fulfill the stated needs. It comprises an assembly for use in the type of whitewater kayak that has a generally planar deck portion a short distance above each knee of a seated user when the user's knees are splayed out against the hull's side walls. The inventive assembly includes a knee-receiving member shaped to receive the anterior and inside surfaces of a substantial portion of the length of the user's distal thigh and knee. Further included are means for selectively securely affixing the knee-receiving member in incrementally different positions to the underside of the kayak's deck portion. The knee-receiving member can be moved forwardly and rearwardly; and, at once, it is also moved generally perpendicularly, closer to or farther from the kayak's central, longitudinal axis. Means are also provided for selectively securely affixing the knee-receiving member to the deck's underside in a plurality of different positions of rotation around a vertical axis. Yet other means are provided for raising and lowering the knee brace. And, an apparatus and method for providing infinitely-fine, incremental adjustment of the position of a brace or pad are provided.

It is an object of the present invention to provide a kayak knee brace which is both longitudinally and laterally adjustable.

It is also an object of the present invention to provide a kayak knee brace which is adjustable in height above the kayaker's knee.

It is a further object of the present invention to provide a kayak knee brace which, when longitudinally adjusted, also adjusts laterally to provide sufficient room for the user's knee between the brace and the hull's side wall.

Yet another object of this invention is to provide a knee brace with a force-receiving panel which lies flush against the inside and anterior surfaces of the user's knee and distal thigh, whether the user has short, wide-splayed legs, or long, less-divergent legs.

Yet a further object of the present invention is to provide a kayak knee brace which is easy to position and reposition securely by a lower-skilled kayak cockpit outfitter, thus reducing the time, labor and cost of achieving a custom cockpit fit.

Still a further object of the present invention is to provide a kayak knee brace which makes it easy for a prospective purchaser of a kayak to field-test the craft under conditions which permit full use of all of its control surfaces without, first, having the cockpit custom foamfitted.

And, yet another object of the invention is to provide an apparatus and method which permit fine incremental adjustments to a brace or pad's position during cockpit custom fitting, while not requiring the kayaker being fitted to exit the cockpit before each repositioning of the brace or pad.

Still further objects of the inventive kayak knee brace disclosed herein will be apparent from the drawings and following detailed description thereof.

DESCRIPTION OF THE PREFERRED EMBODIMENT

Figure 1:
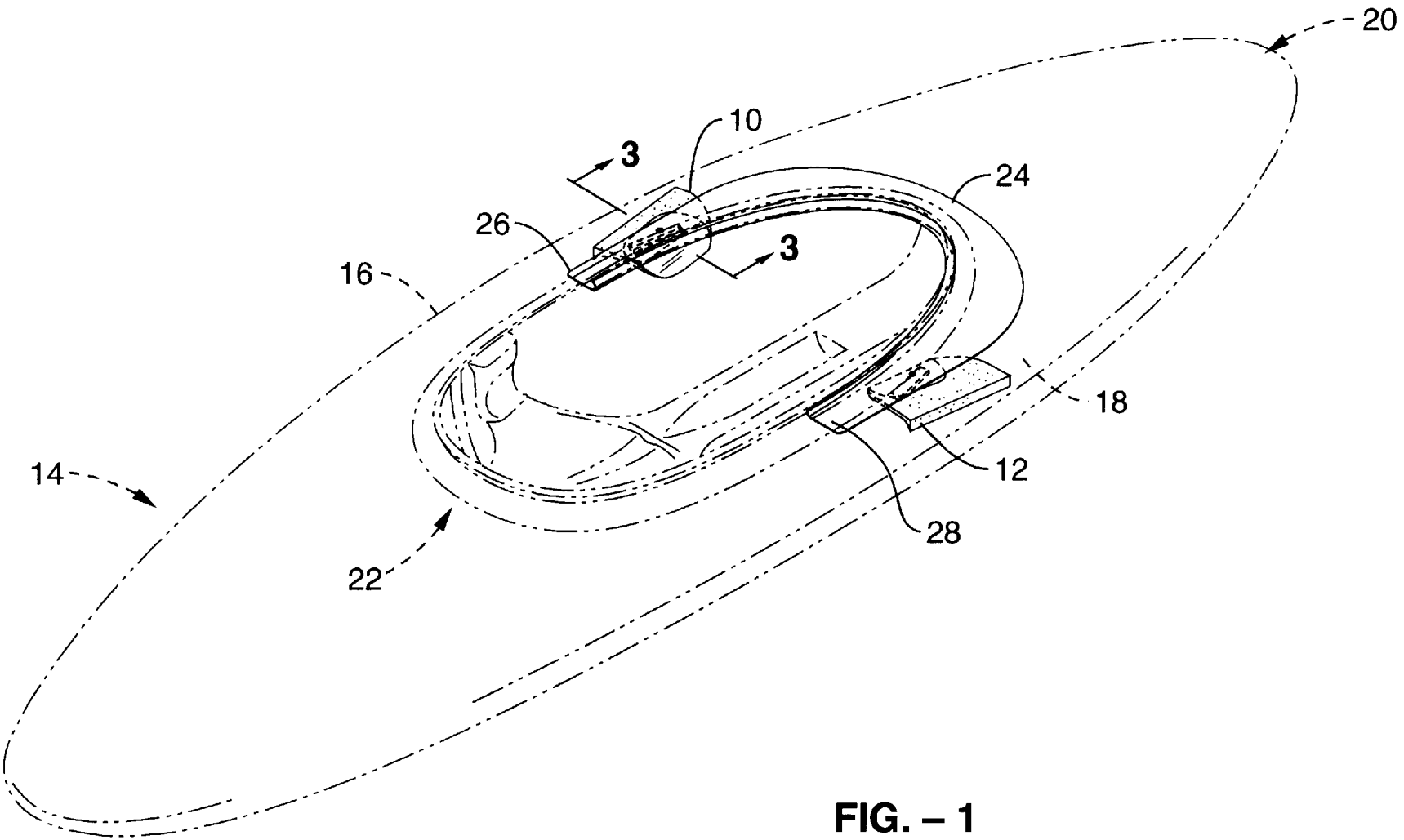
FIG. 1 is a perspective view from the upper right rear of a kayak, with the knee braces of the invention installed therein.

Referring now specifically to the drawings, FIG. 1 shows the inventive knee brace assembly in left and right versions, these being generally identified herein with the reference numerals 10 and 12, respectively.

As shown in FIG. 1, left and right knee brace assemblies 10 and 12 are installed on opposed sides of a conventional plastic or fiberglass whitewater kayak 14. Placement of each knee brace assembly 10, 12 is under its respective left or right portion 16, 18 of foredeck 20 which extends rearward to both sides of cockpit 22.

Figure 2:
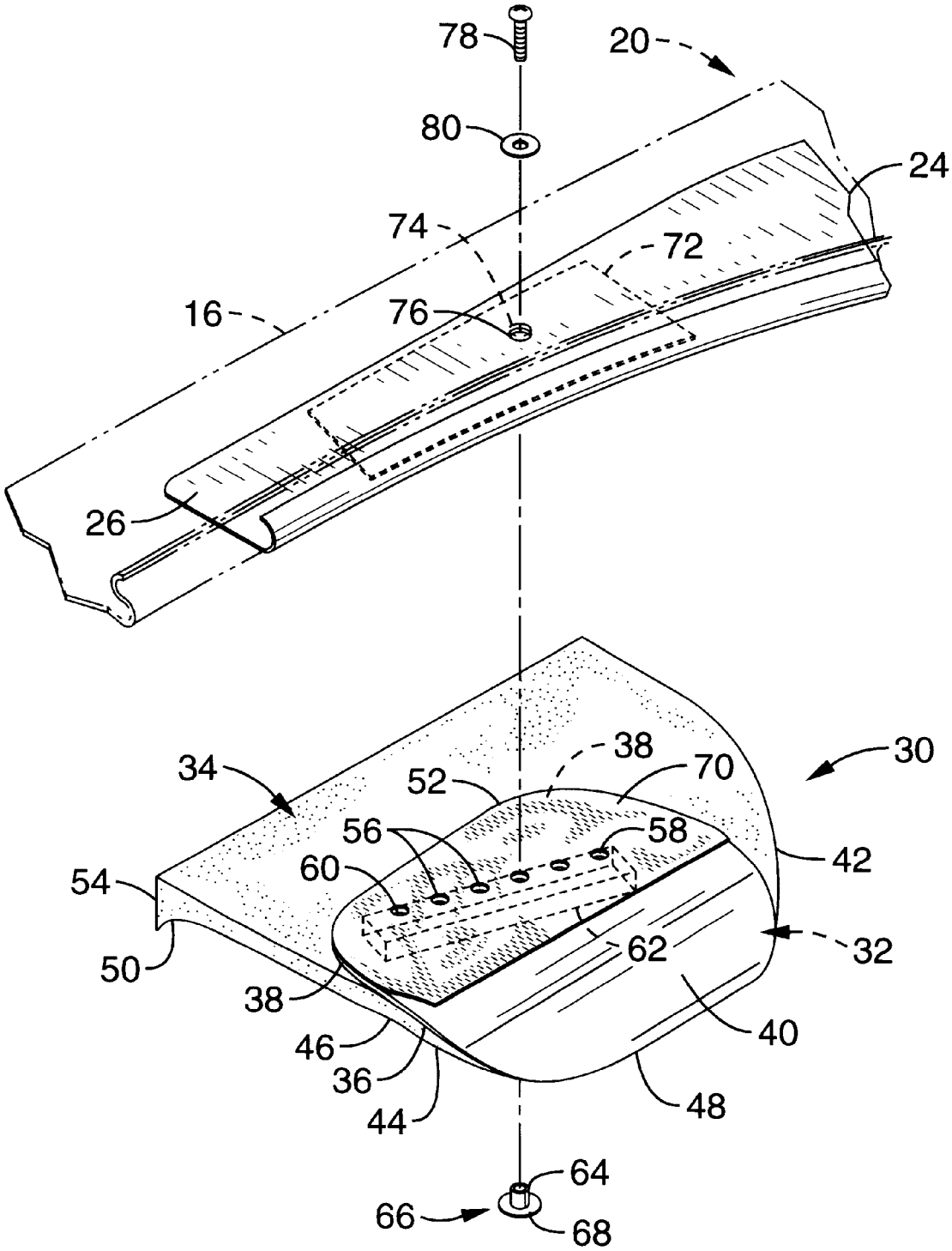
FIG. 2 is an upper right rear fragmentary, exploded, perspective view of the left knee brace assembly of FIG. 1.

Brace assemblies 10, 12 may be affixed directly to the surfaces of the undersides of left and right rearward foredeck portions 16, 18. Or, if desired, kayak 14 may be fitted with a C-shaped brace plate 24 which surrounds and reinforces the front of cockpit 22 and its forward left and right sides as shown in FIGS. 1 and 2. Then, knee brace assemblies 10, 12 may be affixed to the undersurfaces of left and right tail ends 26, 28 of C-shaped brace plate 24.

Left and right knee brace assemblies 10 and 12 are mirror images of one another. Therefore, although the following discussion focuses on the details of left brace assembly 10, it will be understood that the structure and function of right brace assembly 12 is exactly the same.

It will also be understood that although reference is made herein to affixing knee braces to the undersides of brace plates 24, not all kayaks are equipped with brace plates. Therefore, such references should be considered to apply equally to affixing knee braces to the undersides of the rearward portions of kayaks' foredecks, as well. And, likewise, where references are made to affixing braces to the undersides of rearward foredecks, such references should be considered to apply equally to affixation to the undersides of brace plates, as well.

Figure 3:
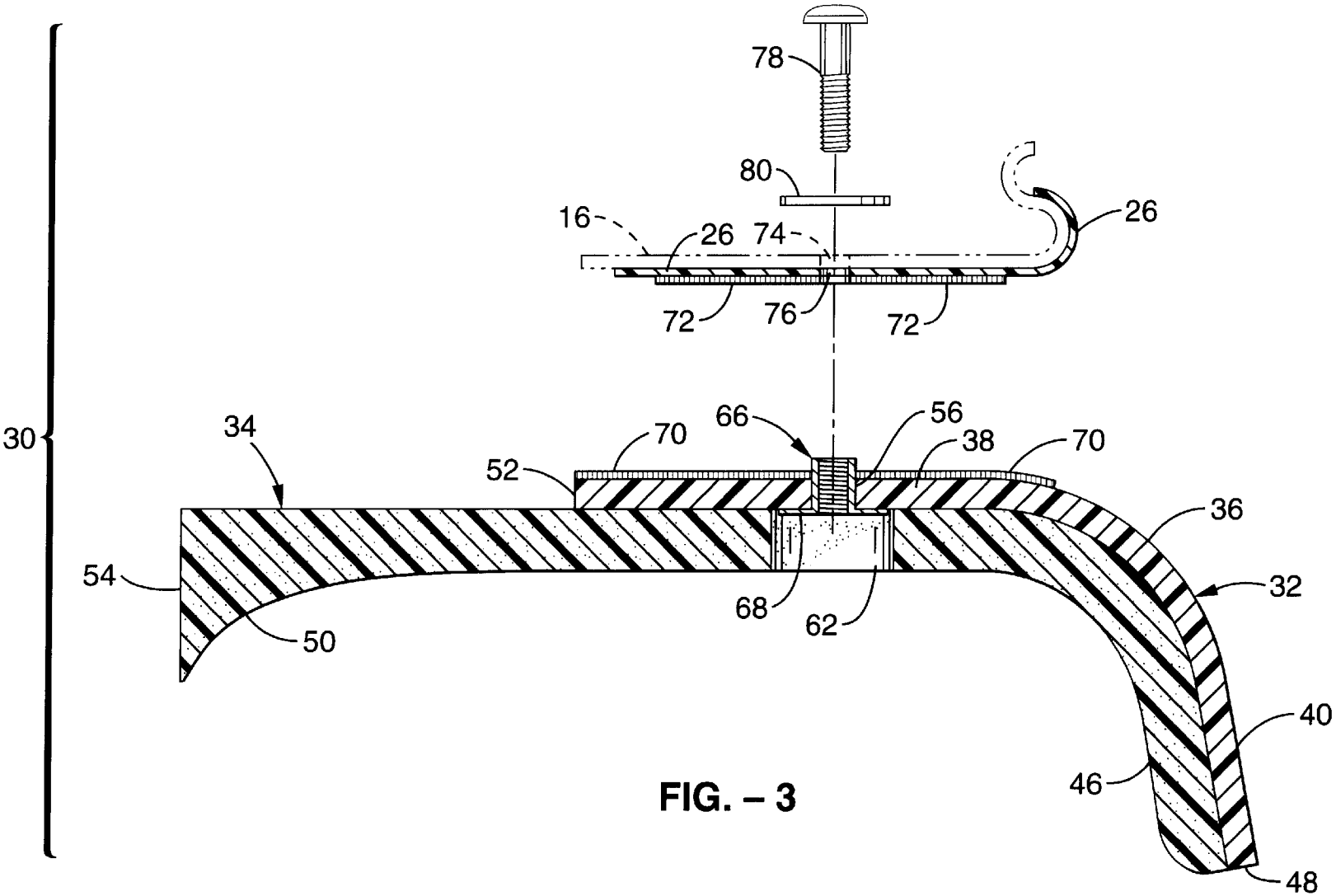
FIG. 3 is a cross-sectional view of the left knee brace assembly of FIG. 1 taken on line of sight 3—3 thereof.
Figure 4:
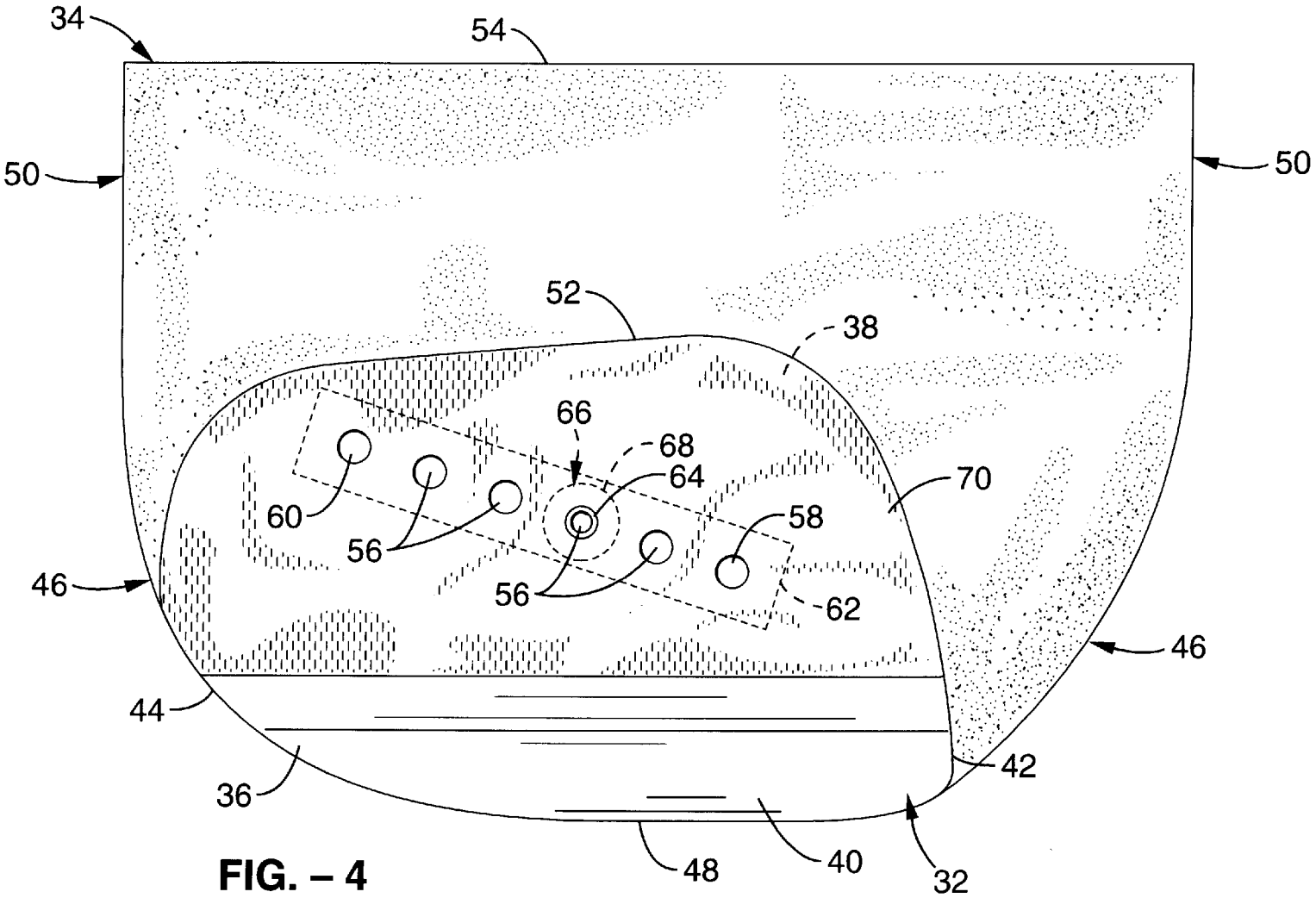
FIG. 4 is a top plan view of the knee brace of the invention.

FIGS. 2, 3 and 4 show that the primary component of left brace assembly 10 is left knee brace 30. Left knee brace 30 is comprised of a bent, rigid plate 32 which serves as knee brace 30's structural portion, or "backbone," and a resilient pad 34 which lines the inside of the curve of rigid plate 32 and extends a substantial distance therebeyond.

Plate 32 is preferably comprised of rigid plastic. Polycarbonate plastic 3/16", or so, thick has been used with success, but polyethylene, PVC, ABS, Plexiglass or other plastics may also work satisfactorily, as may metals such as aluminum or steel for certain purposes. Plate 32 is roughly rectangular in shape, with rounded corners. Its forward to rearward length (when flat, before bending) is roughly 10–12 inches, and its width is roughly 8 inches.

A rounded crease 36 in the direction of plate 32's forward to rearward length divides its width roughly in half. As best viewed in FIG. 3, rounded crease 36 divides plate 32 into first and second integrally-connected plate portions 38 and 40, respectively. Second plate portion 40 depends rigidly and roughly perpendicularly from first plate portion 38 in the embodiment shown herein, giving plate 32 a roughly L-shaped cross section.

Although plate 32 will work satisfactorily if roughly rectangularly shaped and bent at roughly a right angle, slight modifications to that shape have been found to yield somewhat enhanced versatility and comfort. Specifically, it has been found advantageous if forward and rearward edges 42 and 44 are slightly angled so that plate 32 has more the shape of a parallelogram. This is best seen in FIG. 4. Further, an angle of 80 degrees, or so, rather than a sharp right angle, between first and second plate portions 38 and 40 has been found best for use in most modern kayaks.

Resilient pad 34 is comprised of dense, resilient, closed-cell foam of the type commonly used in outfitting kayak cockpits. As best depicted in FIGS. 2 and 3, a first, inner portion 46 of pad 34 lines the inside curve of rigid plate 32 and is conterminous with plate 32's inner edge 48. An outer portion 50 of pad 34, integral with inner pad portion 46, extends a substantial distance, e.g. 4 to 5 inches, or so, beyond plate 32's outer edge 52. This is best viewed in FIGS. 3 and 4.

Pad 34 and plate 32 are bound securely to one another with an appropriate adhesive, or other high-strength bonding substance or method. Any means known in the art to accomplish this will be satisfactory.

The term "inner" as applied to plate 32 and pad 34 shall be understood to refer to the parts of those elements which are closer to the central, longitudinal axis of kayak 14 when knee brace 30 is installed therein and oriented for normal use. Likewise, "outer" as applied to plate 32 and pad 34 shall be understood to refer to the parts of those elements which are farther from kayak 14's central, longitudinal axis.

Pad 34 is roughly ¼" thick throughout the inner portion 46 thereof which lines the adjacent inside faces of plate portions 38 and 40 which form the inside-curved surface of plate 32. The majority of outer portion 50 of pad 34 is also roughly ¼" thick, but pad 34's extreme outer edge 54 is substantially thicker, e.g. 1¼", or so.

Outer portion 50 of pad 34 is free to bend and contour itself as necessary to match the shape of the upper inside face of the left rearward portion 16 of kayak 14's foredeck.

First plate portion 38 includes a series of equidistantly-spaced apertures 56 therethrough, disposed in a linear arrangement. As shown best in the plan view of FIG. 4, apertures 56 are arranged on a line which is offset from crease 36 by roughly 20 degrees, or so, such that the forwardmost aperture 58 is closer to crease 36 than the rearwardmost aperture 60. Six apertures 56 have been found adequate for general purposes, forwardmost aperture 58 and rearwardmost aperture 60 preferably about 3½" apart, with intermediate apertures 56 spaced approximately ¾" from one another.

The cross-section of FIG. 3 shows that a channel 62 is cut out of pad 34 beneath the line of apertures 56 in first plate portion 38. Alternatively, individual apertures may be cut in pad 34, each corresponding to and being aligned with an aperture 56. But, for easy access to both the upper and lower surfaces of first plate portion 38 in the vicinity of each aperture 56, a continuous channel 62 is preferred.

Apertures 56 should be circular and sufficiently dimensioned to receive the cylindrical neck portion 64 of T-nut 66. And, channel 62 should be wide enough for the wide collar 68 of T-nut 66 to pass therethrough and to seat flush against the lower face of first plate portion 38. T-nut 66's cylindrical neck 64 should be the same length as the thickness of plate 32, i.e. approximately 3/16" here in the preferred embodiment.

First plate portion 38 is covered with a first member of a mating pair of hook-and-loop fastening fabric patches, for example, the hooked portion 70 of a pair of Velcro-brand patches. Hooked fabric patch 70 is generally rectangular and includes a series of openings (not separately numbered) which register with apertures 56. Hooked fabric patch 70 must be very securely bound first plate portion 38. Any adhesive or other means known in the art to accomplish this will be satisfactory.

A complementary patch of mating hook-and-loop fabric, looped fabric patch 72, is securely affixed to the upper inside face of the left rearward portion 16 of kayak 14's foredeck. Alternatively, where a C-shaped brace plate 24 is employed to reinforce the forward portion of cockpit 22's rim, looped fabric patch 72 is applied to the lower surface of brace plate 24. This arrangement is shown in FIG. 3.

As shown in FIGS. 2, 3 and 4, an aperture 74 through the left rearward portion 16 of kayak 14's foredeck registers with an aperture 76 in the left, tail portion 26 of C-shaped brace plate 24 when C-shaped brace plate 24 is bound properly in place. A corresponding opening (not separately numbered) in looped fabric patch 72 permits round-head screw 78 to pass unimpeded, downward through deck aperture 74, through brace plate aperture 76, and through the opening therebeneath in looped fabric patch 72 for threaded engagement with T-nut 66 seated in first plate portion 38.

In use, in preparing to position knee brace 30 in the best location for the size of a particular individual user's leg, the user first sits in the cockpit with legs splayed and knees against the side walls of the hull, up under the rearward side portions 16, 18 of the foredeck. Then, knee brace 30 is slipped into place and positioned for proper contact with the user's left knee and distal thigh. This position is marked for reference, for example, by drawing a short line with a felt marker on cockpit 22's rim above the forward and rearward edges of knee brace 30. Then, round-head screw 78 is passed through washer 80, downward through deck aperture 74 and brace plate aperture 76, and out through the opening therebeneath in looped fabric patch 72. Using the reference marks made on cockpit 22's rim, the projecting end of screw 78 is then placed through that aperture 56 which keeps knee brace 30 as close as possible to the position indicated by the reference marks. Using care not to permit mating fabric patches 70 and 72 to engage, T-nut 66 is passed up through channel 62 in pad 34 and threaded onto screw 78 projecting through the chosen aperture 56. Then, rotating knee brace 30 around the vertical axis of rotation provided by screw 78, and using the seated kayaker's distal thigh and knee for a reference, knee brace is adjusted to that angle which causes second plate portion 40 to lie flush and most comfortably against the inside anterior face of the kayaker's distal thigh and knee.

Once knee brace 30 is set longitudinally and rotationally, screw 78 may be turned until T-nut 66 is seated flush and locked in place against the underside of first plate portion 38. As will be understood by one skilled in the mechanical arts, it may be advantageous to draw screw 78 upward before turning it so that T-nut 66 is held in place by the friction of collar 68's engagement with first plate portion 38. As will be further understood, it may be advantageous to provide T-nut 66's collar with prongs or teeth to enhance the collar's ability to grip the underside of first plate portion 38.

Once knee brace 30 is set in place, its first plate portion 38 is generally horizontal, or tipped slightly downward in the outward direction if the kayak's side deck is sloped that way. Second plate portion 40 projects downward from the side of cockpit 22's rim, and slightly toward the kayak's center. This angle depends upon the angle between first and second plate portion 38 and 40, and the angle of the kayak's side deck.

In adjusting knee brace 30 for another user, screw 78 is removed from its apertures 74 and 76 in kayak 14 and C-shaped base plate 24, and T-nut 66 is withdrawn from the original aperture 56 in first plate portion 38. Placement forwardly or rearwardly is as aforedescribed. However, the 20-degree angle of the line of apertures 56 causes knee brace 30 to travel approximately 1 ½" laterally in moving between brace plate 30's forwardmost and rearwardmost positions. This assures that even those kayakers with the longest legs have sufficient room between the padding on second panel portion 40 and the kayak's side wall.

Figure 5:
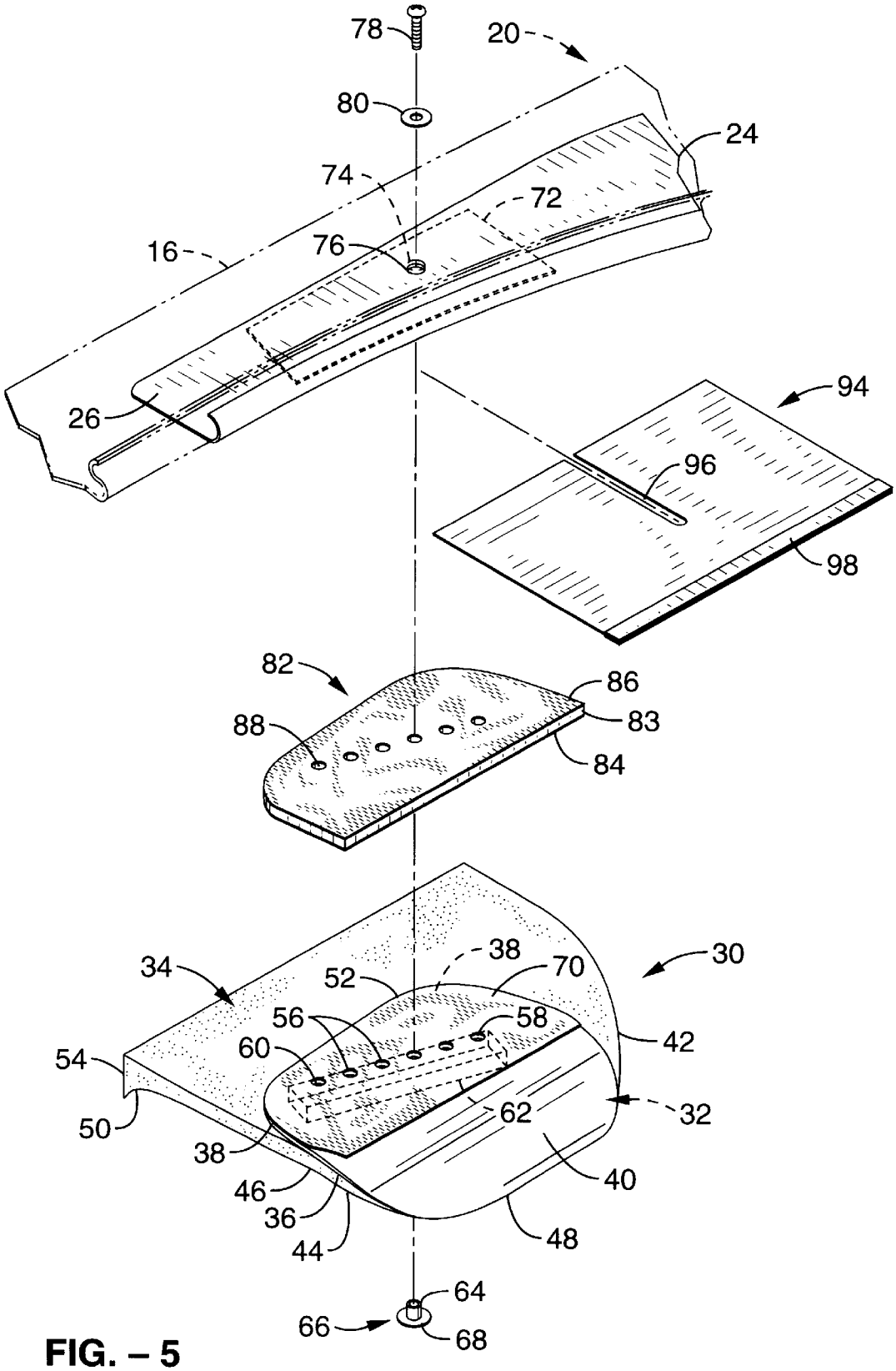
FIG. 5 is an upper right rear fragmentary, exploded, perspective view of an alternative embodiment of the left knee brace assembly of the invention, showing a shim for raising and lowering the knee brace, and showing the slip card used to prevent engagement of the opposed Velcro layers during final rotational positioning.
Figure 6:
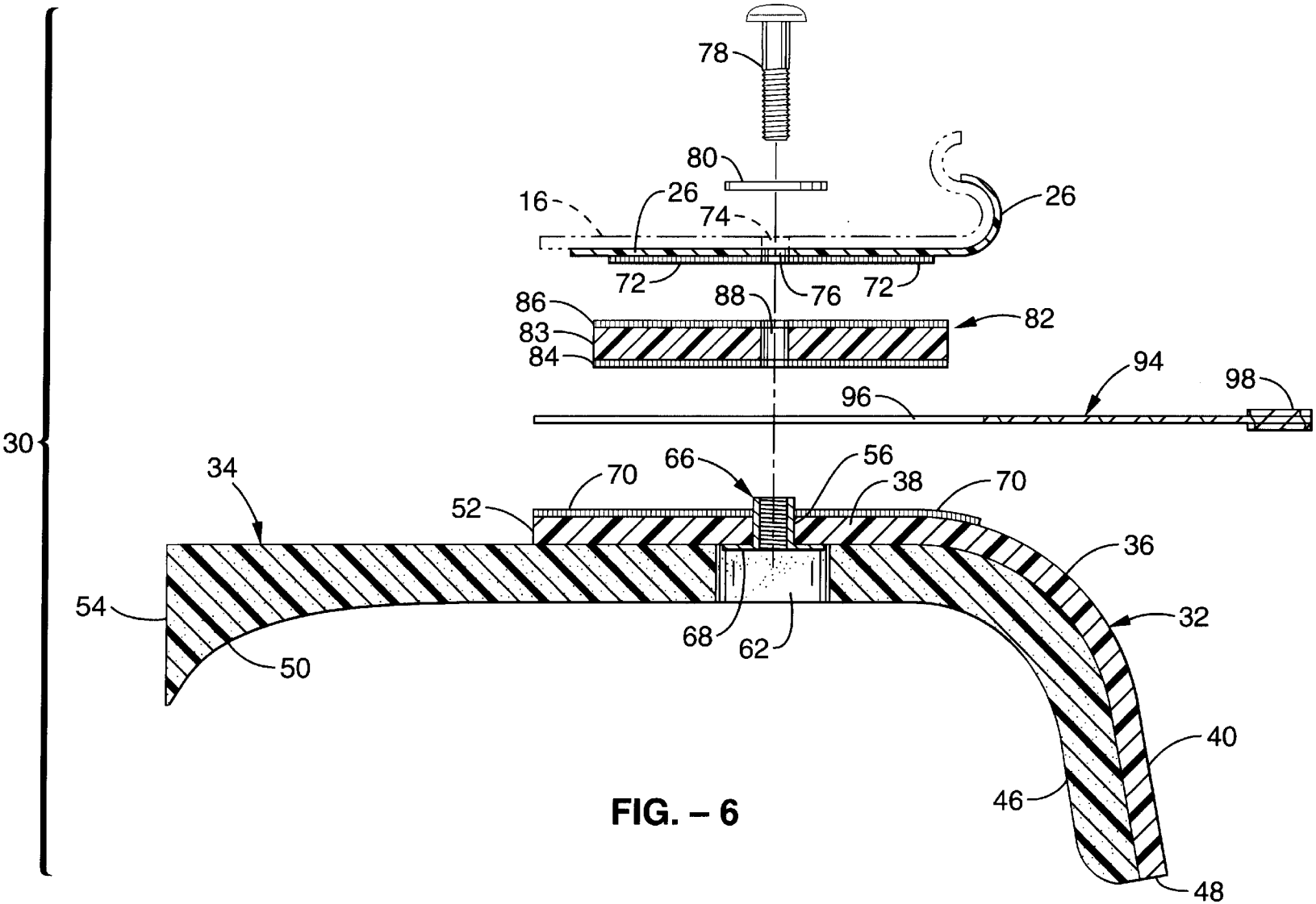
FIG. 6 is a cross-sectional view of the left knee brace assembly of FIG. 5 taken on a line of sight similar to line of sight 3—3 of FIG. 1.

Although the aforedescribed embodiment of the invention works satisfactorily as described, additional elements shown in FIGS. 5 and 6 yield further adjustability in the fit. Specifically, shim 82 permits knee brace 30 to be set in different horizontal planes closer to, or farther away from, the plane of left rearward foredeck portion 16. That is, shim 82 permits knee brace 30 to be raised or lowered, depending on the kayaker's needs.

Shim 82 is comprised of a planar sheet of substantially rigid core material 83, preferably of plastic composition, having a shape generally similar to that of hooked fabric patch 70. Shim 82 may have any desired thickness, but dimensions of 1/16 inch to ¼ inch are expected to work satisfactorily. Shim 82 includes a covering layer of looped fabric 84 securely affixed to the lower face of rigid sheet 83, and a covering layer of hooked fabric 86 securely affixed to rigid sheet 83's upper face. Thus, looped fabric covering layer 84 on the lower face of shim 82 is adapted to engage hooked fabric patch 70 atop left brace 30; and, hooked fabric covering layer 86 on the upper face of shim 82 is adapted to engage looped fabric patch 72 affixed to the underside of left rearward foredeck portion 16, or to the undersurface of left tail end 26 of C-shaped brace plate 24, if so equipped.

Shim 82 is preferably provided with a linearly-arranged series of apertures 88 which are positioned and dimensioned to correspond substantially with apertures 56, 58 and 60 through first plate portion 38. Apertures 88 pass through lower and upper fastening fabric layers 84 and 86, as well as through shim 82.

In use, before positioning knee brace 30, shim 82 is laid atop first plate portion 38 such that looped fabric covering layer 84 on shim 82's lower face is engaged with hooked fabric patch 70, and such that apertures 88 are aligned with apertures 56, 58 and 60. Then, knee brace 30 is installed as described above, by marking its preferred position; passing screw 78 down through the deck, brace plate and knee brace; making the final rotational adjustment around the vertical axis defined by screw 78; and, finally, tightening down the assembly. Alternatively, shim 82's upper hooked fabric covering layer 86 may first be engaged with the looped fabric patch 72.

If desired, multiple shims 82, or shims 82 of different thicknesses, may be used to raise or lower knee brace 30 in accordance with the kayaker's needs. If multiple shims 82 are used, the mating fabric on the upper and lower face of each shim 82 will engage the complementary mating fabric on the next adjacent shim 82. Kayaks having decks higher above kayakers' knees will likely need thicker shims 82, or greater numbers of shims. Low-decked kayaks will require fewer or thinner shims 82, or perhaps no shims at all.

Figure 7:
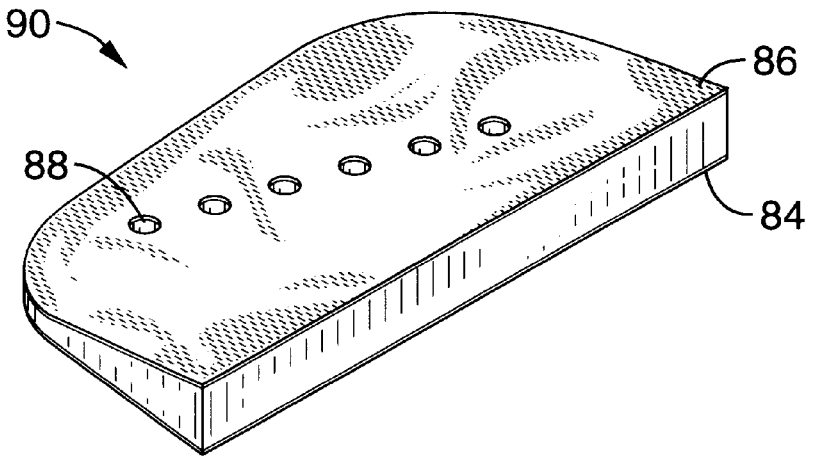
FIG. 7 is an upper right rear perspective view of an alternative shim, having a tapering thickness from one side to the other.
Figure 8:
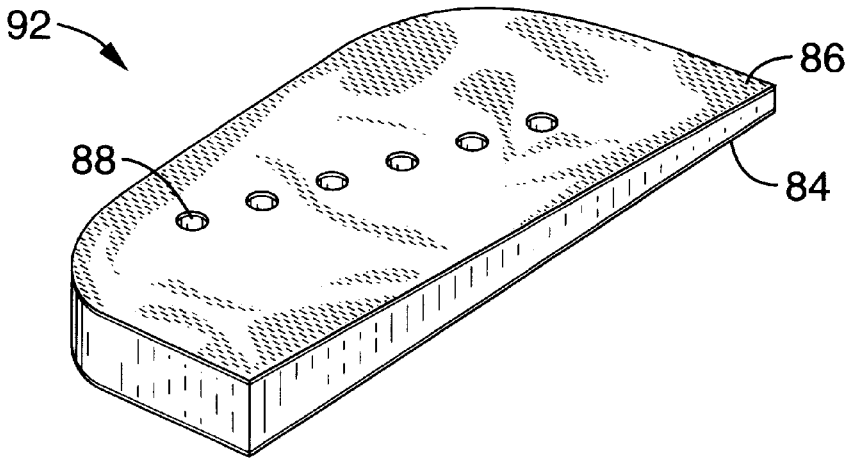
FIG. 8 is an upper right rear perspective view of an alternative shim, having a tapering thickness from one end to the other.

It is also contemplated that alternative-shaped shims may help cant knee brace 30 in different planes, as might be necessary when a kayak's deck slopes in a direction that causes second plate portion 40 and inner portion 46 of pad 34 to reside in a plane uncomfortable or non-optimum for a particular kayaker. In that case, first alternative shim 90, having a tapering thickness from one side to the other, may compensate for the deck's slope. See FIG. 7. For other custom-fitting purposes, second alternative shim 92, having a tapering thickness from one end to the other, may be most useful. See FIG. 8.

FIGS. 5 and 6 also show slip card 94, which acts as a barrier to prevent engagement of opposing faces of hook and loop fabric patches while the parts to which they are bound are being adjusted in relation to one another. Specifically, slip card 94 aids in the final, rotational positioning of knee brace 30 around the vertical axis defined by the shank of round-head screw 78.

Slip card 94 is generally rectangular, but the shape of its outer perimeter is not critical as long as slip card 94 is larger than any of the sheets of hook and loop fabric it is intended to keep separated. That is, slip card 94 must have a larger perimeter than hooked fabric patch 70; than looped fabric patch 72; than looped fabric covering layer 84; and, than hooked fabric covering layer 86.

Slip card 94 is preferably constructed of durable, smooth-surfaced, moderately flexible, planar sheet material such as thin plastic; glazed paper; cardboard, or some other material having a low-friction surface with respect to hook and loop fabric. Slip card 94 includes slot 96, which is preferably disposed on a line generally bisecting slip card 94. However, slot 96 does not traverse the entire width of slip card 94; slot 96 is only approximately two-thirds the width thereof. The width of slot 96, in turn, is preferably slightly greater than the width of the shank of round-head screw 78.

The unbroken edge of slip card 94 perpendicular to slot 96 is thickened to form grip edge 98, such as by folding or other such means.

In use, when knee brace 30 is being mounted without shim 82, slip card 94 is placed between hook and loop fabric patches 70 and 72, and slot 96 is aligned with aperture 74 in rearward foredeck portion 16; with aperture 76 in tail portion 26 of brace plate 24; and, with one aperture 56, 58, 60 of knee brace 30. The determination of which aperture 56, 58, 60 of knee brace 30 is aligned with slot 96 depends on the preliminarily-marked position of knee brace 30. This arrangement allows round-head screw 78 to pass through slot 96 as it passes downward through deck 13 and brace plate tail 26, and into engagement with T-nut 66 seated in knee brace 30.

Slip card 94 is also preferably oriented so that grip edge 98 is exposed and able to be easily grasped. This is suggested in FIG. 5 where it can be seen that grip edge 98 would project from beneath rearward foredeck portion 16, toward the central, longitudinal axis of kayak 14.

Once slip card 94 is in place between mating hook and loop fabric patches 70 and 72, screw 78 may be tightened so as to draw knee brace 30 fairly tightly up under rearward foredeck 16. Screw 78 should be tight enough to prevent slippage of knee brace 30's position, but loose enough to permit knee brace 30 to be moved as desired. However, even if screw 78 is made fairly tight, slip card 94's low-friction surface keeps mating patches 70 and 72 substantially separated, and permits knee brace 30 to continue to be rotated for infinitely-fine, incremental adjustment about that vertical axis defined by the shaft of screw 78. This final rotational adjustment may be carried out while the kayaker being fitted remains in cockpit 22, with the inside anterior face of his or her distal thigh and knee fully engaged with knee brace 30.

It is acknowledged that slot 96 permits very small portions of mating patches 70 and 72 to touch one another, and perhaps to engage, while knee brace 30 is being rotatingly positioned. However, it has been found that if the width of slot 96 is kept to a minimum, the binding action between mating patches 70 and 72 is minimal and does not interfere with the action of positioning brace 30.

Once the final, optimal rotational position of knee brace 30 is achieved, the grip edge 98 of slip card 94 may be firmly grasped and pulled in a generally horizontal direction toward kayak 14's central longitudinal axis. As grip edge 98 is pulled in a direction perpendicular to grip edge 98, slip card 94 travels in the direction of pull, unimpeded by screw 78 because of the clearance provided by slot 96. Neither is the travel of slip card 94 significantly impeded by frictional force on its upper and lower faces from mating patches 70 and 72, as long as slip card 94 is constructed of a material having a sufficiently low-friction surface.

Once slip card 94 is removed from between mating fabric patches 70 and 72, they are free to engage with one another, thus fixing knee brace 30's position with respect to the underside of rearward foredeck portion 16. The durable, flexible character of slip card 94 makes it able to be pulled out easily, even if obstructed somewhat by other features within or around the rim of cockpit 22.

Once slip card 94 is removed from between mating fabric patches 70 and 72, and their surfaces are in contact with one another, the best engagement of patches 70 and 72 is achieved by pressing on knee brace 30, by hand, over the entirety of its surface, and by turning screw 78 a bit farther to cinch up knee brace 30 as close and as tightly as possible under rearward foredeck portion 16.

If slip card 96 is used with one or more shims 82, 90 or 92, slip card 96 may be placed between any two mating faces thereof, or between the mating face of a shim and either looped fabric patch 70 or hooked fabric patch 72.

It is contemplated that slip cards of many different shapes and sizes may be used between any mating hook and loop fabric layers to permit final, infinitely-fine, incremental adjustments of a great variety of different types of kayak braces and pads; different types of body part-engaging elements for other purposes; and, a broad range of other types of mating mechanical elements. Assemblies wherein two, three or more separate slip cards are employed are also envisioned. Assemblies are also contemplated wherein no central screw or other axis-providing element is employed. As long as there is provided some means for temporarily holding adjacent, mating fabric-faced elements in place, yet permitting them to be moveable as their positions relative to one another are being adjusted, a slip card-type barrier between them will permit infinitely-fine, incremental, final adjustment without engagement of the mating fabric hindering the final positioning. Then, once the final position is reached, the slip card may be removed, and the mating fabric may be permitted to engage.

The foregoing detailed disclosure of the inventive knee brace assembly 10, 12 is considered as only illustrative of the preferred embodiment of, and not a limitation upon the scope of, the invention. Those skilled in the art will envision many other possible variations of the structure disclosed herein that nevertheless fall within the scope of the following claims. For example, the angle between plate portions 38 and 40 may be set, as necessary, during the manufacturing process in order to accommodate differently-shaped kayaks and any consumer demand for knee braces with different configurations. Further, if the plastic used in construction of plate 32 is of a type which may be temporarily softened with the application of heat, the angle between plate portions 38 and 40 may be set, and even later re-set, as desired. Plates 32 constructed of metal may be similarly custom-shaped.

Yet further, there are many known mechanical equivalents to the structural, padding and adjustment mechanisms disclosed herein that will be foreseen by one having ordinary skill in the art. Substitution of such equivalents for those disclosed shall nevertheless fall within the spirit of the invention.

And, alternative uses for this inventive knee brace assembly may later be realized. For example, it may be used for retaining and receiving force from other body parts in the context of kayaking or other sports or endeavors. Accordingly, the scope of the invention should be determined with reference to the appended claims, and not by the examples which have herein been given.

I claim:

1. An adjustable knee brace assembly for use in a kayak, wherein the kayak has a generally planar deck portion a short distance above the knee of a seated user, said adjustable knee brace assembly comprising:

a. a knee-receiving member having forward and rearward ends, said knee-receiving member being shaped to receive the anterior and inside surfaces of a substantial portion of the length of the user's distal thigh and knee;

b. means for selectively securely affixing said knee-receiving member in incrementally different positions forwardly and rearwardly to an underside of said kayak's deck portion, above the user's distal thigh and knee;

c. means for selectively securely affixing said knee-receiving member to said underside of said kayak's deck portion in incrementally different positions closer to or farther from said kayak's central, longitudinal axis; and, d. means for selectively securely fixing said knee-receiving member in a plurality of different positions of rotation around a vertical axis.

2. The assembly of claim 1, wherein said forwardly/rearwardly affixing means comprises a fastener through said deck portion and a plurality of apertures through said knee-receiving member, each said aperture being dimensioned to receive said fastener, at least one of said apertures being closer to said forward end of said knee-receiving member than another of said apertures.

3. The assembly of claim 1, wherein said means for affixing said knee-receiving member closer to or farther from said kayak's central, longitudinal axis comprises a fastener through said deck portion and a plurality of apertures through said knee-receiving member, each said aperture being dimensioned to receive said fastener, at least one of said apertures being closer to said kayak's central, longitudinal axis than another of said apertures.

4. The assembly of claim 1, wherein said rotation position-fixing means further comprises means for causing said forward end of said knee-receiving member to move closer to said kayak's central, longitudinal axis when said rearward end of said knee-receiving member is moved farther from said kayak's central, longitudinal axis, and vice versa.

5. The assembly of claim 1, wherein said rotation position-fixing means comprises a fastener having a generally vertically-oriented shaft passing through said deck portion and through an aperture in said knee-receiving member, said knee-receiving member being rotatable on said shaft of said fastener, said rotation position-fixing means further including means lateral to said fastener shaft for affixing an upper surface of said knee-receiving member to said underside of said kayak's deck portion.

6. The assembly of claim 1, wherein a portion of said knee-receiving member is substantially planar, and wherein when said knee-receiving member is installed in said kayak, said substantially planar portion of said knee-receiving member is disposed generally parallel to the plane of said underside of said kayak's deck portion.

7. The assembly of claim 6, wherein said rotation position-affixing means comprises a first member of a pair of mating fabric patches disposed upon said underside of said kayak's deck portion and a second, complementary member of said pair of mating fabric patches disposed upon an upper surface of said substantially planar portion of said knee-receiving member.

8. The assembly of claim 7, further including a fastener with a generally vertical shaft passing through said deck portion and through an aperture in said knee-receiving member, said knee-receiving member being rotatable on said shaft of said fastener.

9. The assembly of claim 1, further including means for causing said knee-receiving member to become incrementally closer to said kayak's central, longitudinal axis as said knee-receiving member is moved incrementally forward, and for causing said knee-receiving member to become incrementally farther from said kayak's central, longitudinal axis as said knee-receiving member is moved incrementally rearward.

10. The assembly of claim 1, wherein said knee-receiving member has a curved cross-section transverse to its forward-rearward length.

11. The assembly of claim 1, wherein said knee-receiving member includes means depending therefrom along one side thereof for receiving force from the inner anterior face of said user's distal thigh and knee directed toward said kayak's central, longitudinal axis.

12. The assembly of claim 11, wherein said knee-receiving member further includes a substantially planar portion adapted to be oriented generally horizontally against said underside of said kayak's deck portion.

13. The assembly of claim 12 wherein said planar portion of said knee-receiving member further includes a plurality of apertures therethrough, said apertures being disposed along a line nonparallel to the plane in which said depending, force-receiving means resides.

14. The assembly of claim 1, wherein said knee-receiving member includes a rigid structural portion and a padded knee-engaging portion.

15. The assembly of claim 14, wherein a first portion of said rigid structural portion is substantially planar and adapted to be oriented generally horizontally against said underside of said kayak's deck portion.

16. The assembly of claim 15, wherein a second portion of said rigid structural portion depends rigidly and roughly perpendicularly from said first portion of said rigid structural portion.

17. The assembly of claim 1, wherein said knee-receiving member includes a rigid structural portion having a roughly L-shaped cross-section transverse to its forward-rearward length.

18. The assembly of claim 17, wherein said L-shaped, rigid structural member is comprised of first and second generally planar portions, said first planar portion being adapted to be oriented generally horizontally against said underside of said kayak's deck portion, said second planar portion depending rigidly and roughly perpendicularly from one side of said first portion.

19. The assembly of claim 18, further including padding on adjacent, inside faces of said L-shaped, rigid structural member.

20. The assembly of claim 19, wherein said first planar portion includes an outer side edge opposite the side from which said second planar portion depends, said knee-receiving member further including a semirigid pad projecting parallel to and substantially beyond said first planar portion's outer side edge.

21. The assembly of claim 20, said projecting semirigid pad further including an outer side edge portion depending therefrom for receiving force from the outer anterior face of said user's knee directed away from said kayak's central, longitudinal axis.

22. The assembly of claim 1, further including means for selectively altering the distance between said knee-receiving member and said underside of said kayak's deck portion.

23. The assembly of claim 22, wherein said distance altering means comprises a shim able to be fixed securely between said knee-receiving member and said underside of said kayak's deck portion.

24. The assembly of claim 23, wherein said shim is substantially planar.

25. The assembly of claim 23, wherein said shim has a tapering thickness from one side to the other.

26. The assembly of claim 23, wherein said shim has a tapering thickness from one end to the other.

27. The assembly of claim 23, wherein said shim is comprised of a rigid, central core, said core having upper and lower surfaces, each said surface being covered with a layer of fastening fabric.

28. The assembly of claim 1, wherein said rotation position-fixing means includes means for permitting infinitely-fine, incremental adjustment of said knee-receiving member with respect to said kayak's deck.

29. The assembly of claim 1, wherein said rotation position-fixing means comprises:

a. a first member of a mating fabric patch pair affixed to said underside of said kayak's deck;

b. a second member of said mating fabric patch pair affixed to an upper face of said knee-receiving member;

c. a removable barrier between said first and second fabric patches; and, d. means for temporarily holding said knee-receiving member in place, yet permitting the position of said knee-receiving member to be adjusted.

30. The assembly of claim 29, wherein said means for temporarily holding said knee-receiving member in place comprises a screw through, and perpendicular to, said kayak's deck portion and said knee-receiving member.

31. The assembly of claim 29, wherein said removable barrier comprises a generally planar sheet having low-friction surfaces.

32. The assembly of claim 29, wherein said barrier includes a slot therein.

33. The assembly of claim 29, wherein one edge of said barrier is thickened.

34. Apparatus for binding a first object to a second object in a precise position, wherein said second object has a face with a shape complementary to a face on said first: object, the apparatus comprising:

a. a first member of a mating fabric patch pair adapted to be affixed to said face of said first object;

b. a second member of said mating fabric patch pair adapted to be affixed to said complementary face of said second object; and, c. a barrier adapted to be placed between said first and second mating fabric patches while the relative position of said first and second objects with respect to one another is being adjusted.

35. The apparatus of claim 34, wherein said first and second members of said mating fabric patch pair comprise a patch of hooked fabric and a patch of looped fabric.

36. The apparatus of claim 34, further including means for selectively securely fixing said second object in a plurality of different positions of rotation with respect to said first object.

37. The apparatus of claim 36, wherein said rotation position-fixing means comprises a fastener having a shaft passing through said first object, and through an aperture in said second object, said second object being rotatable on said shaft of said fastener.

38. Apparatus of claim 37, further including means lateral to said fastener shaft for affixing a surface of said first object to a vehicle.

39. The apparatus of claim 34, wherein said removable barrier comprises a generally planar sheet having low-friction surfaces.

40. The apparatus of claim 34, wherein said barrier includes a slot therein.

41. The apparatus of claim 34, wherein one edge of said barrier is thickened.

42. A method for adjusting the relative positions of first and second objects with respect to one another, and then securely affixing said first and second objects to one another in a precise position, the method comprising the steps of:

a. affixing a first member of a mating fabric patch pair to a face of said first object;

b. affixing a second member of said mating fabric patch pair to a face of said second object;

c. placing a planar barrier between said faces of said first and second objects;

d. moving said first and second objects toward one another such that said first and second mating fabric patches contact opposed faces of said planar barrier;

e. adjusting the relative position of said first and second objects with respect to one another, while said first and second mating fabric patches remain in contact with opposed faces of said planar barrier; and, f. removing said planar barrier from between said first and second mating fabric patches, and permitting said mating fabric patches to engage with one another.

43. A method for adjusting and fixing the position of a brace in a kayak, wherein a first patch of a mating fabric patch pair is affixed to the kayak and a complementary second patch of the mating fabric patch pair is affixed to the brace, the method comprising the steps of:

a. placing a planar barrier between said first and second mating fabric patches such that said first and second mating fabric patches are in contact with opposed faces of said planar barrier;

b. adjusting said brace into its final position; and, c. withdrawing said planar barrier from between said first and second mating fabric patches, an,. permitting said mating fabric patches to engage with one another.

* * * * *